US010254095B1

(12) United States Patent
Wang

(10) Patent No.: US 10,254,095 B1
(45) Date of Patent: Apr. 9, 2019

(54) LIGHTED NOCK DEVICE

(71) Applicant: Xiamen Kejiang Industry and Trade CO., LTD., Fujian (CN)

(72) Inventor: Shuming Wang, Fujian (CN)

(73) Assignee: Xiamen Kejiang Industry and Trade CO., LTD., Fujian (CN)

( * ) Notice: Subject to any disclaimer, the term of this patent is extended or adjusted under 35 U.S.C. 154(b) by 0 days.

(21) Appl. No.: 15/860,689

(22) Filed: Jan. 3, 2018

(30) Foreign Application Priority Data

Dec. 15, 2017 (CN) ..... 2017 1 1352640

(51) Int. Cl.

| | |
|---|---|
| ***F42B 6/06*** | (2006.01) |
| ***F42B 12/38*** | (2006.01) |
| ***F21V 23/04*** | (2006.01) |
| ***F21V 23/06*** | (2006.01) |
| ***F21S 9/02*** | (2006.01) |
| *F21Y 115/10* | (2016.01) |

(52) U.S. Cl.
CPC ..... *F42B 12/382* (2013.01); *F21S 9/02* (2013.01); *F21V 23/04* (2013.01); *F21V 23/06* (2013.01); *F42B 6/06* (2013.01); *F21Y 2115/10* (2016.08)

(58) Field of Classification Search
CPC ..... F42B 6/06; F42B 12/382; F42B 12/42
USPC ..... 473/570, 578
See application file for complete search history.

(56) References Cited

U.S. PATENT DOCUMENTS 4,340,930 A * 7/1982 Carissimi ..... F21V 33/008 362/110
5,058,900 A * 10/1991 Denen ..... F21V 33/008 200/276
5,134,552 A * 7/1992 Call ..... F21L 15/00 362/109
6,123,631 A * 9/2000 Ginder ..... F42B 6/06 473/570
7,316,625 B2 * 1/2008 Takahashi ..... A63B 65/00 473/570
7,837,580 B2 * 11/2010 Huang ..... F42B 6/06 473/570
8,342,990 B1 * 1/2013 Price ..... F42B 6/06 473/570
8,944,944 B2 * 2/2015 Pedersen ..... F42B 12/382 473/570
9,028,347 B2 * 5/2015 Pedersen ..... F42B 6/06 473/578
9,546,851 B2 * 1/2017 Kim ..... F42B 12/382
9,677,859 B1 * 6/2017 Kim ..... F42B 6/06
9,702,671 B2 * 7/2017 Minica ..... F42B 6/06
9,702,672 B1 * 7/2017 Kim ..... F42B 6/06
2003/0171174 A1 * 9/2003 Price ..... F42B 6/06 473/578
2012/0100942 A1 * 4/2012 Minica ..... F42B 6/06 473/570

* cited by examiner

*Primary Examiner* — Alexander Niconovich
(74) *Attorney, Agent, or Firm* — JCIPRNET

(57) ABSTRACT

The invention discloses a lighted nock device, including a nock body, an LED, a battery, a conductive mounting base, a conductive shift block and an on-off component arranged between the conductive shift block and the conductive mounting base to control connection and disconnection of the conductive shift block and the conductive mounting base. Connection and disconnection of the battery and the LED can be achieved quickly, so that the LED can be turned on or off quickly, with convenient operation and recycling use.

7 Claims, 9 Drawing Sheets

LIGHTED NOCK DEVICE

CROSS-REFERENCE TO RELATED APPLICATION

This application claims the priority benefit of China application serial no. 201711352640.9, filed on Dec. 15, 2017. The entirety of the above-mentioned patent application is hereby incorporated by reference herein and made a part of this specification.

TECHNICAL FIELD

The invention relates to the technical field of bow and arrow, and more particularly, to a lighted nock device.

BACKGROUND ART

A bow is composed of elastic limbs and a ductile bowstring. An arrow includes an arrowhead, an arrow shaft and fletchings. The arrowhead is made of copper or iron (modern arrowheads are mostly made of alloy), the arrow shaft is made of bamboo or wood (modern arrow shafts are mostly made of pure carbon or aluminum alloy), the fletchings are feathers of eagles, hawks or geese, and arrows are important tools used by the army and hunters.

The use of a lighted nock for bow and arrow activities is known because the lighted nock allows users to track an arrow in low-light conditions. An existing lighted nock is typically lighted with an LED powered by a small battery (typically lithium-type). The nock is either optically transparent or semi-transparent so that the LED light source can light up the nock when the battery power is applied. Typically the act of inserting the battery/LED lights up the nock. The act of inserting the battery requires that the nock assembly be removed from the arrow shaft. Then the assembly must be re-installed once the nock is lit. The nock must be removed again to turn the light off. The need to repeatedly remove the nock is troublesome and inconvenient.

SUMMARY OF THE INVENTION

In view of the defects of the prior art, the invention aims to provide a lighted nock device which allows an LED in a lighted nock to be turned on or off quickly so as to realize convenient operation.

To achieve the above object, the invention provides the following technical solutions:

a lighted nock device includes a nock body, an LED and a battery, wherein the LED includes a lamp body, and a positive pin and a negative pin which are connected with the lamp body. The lighted nock device further includes a conductive mounting base, wherein the LED is arranged on the nock body, the battery is arranged in the conductive mounting base, the negative electrode of the battery is in contact with the conductive mounting base, one end of the nock body is inserted into the conductive mounting base, the positive pin is connected with the positive electrode of the battery, a conductive shift block is slidably arranged on the nock body, the conductive shift block is in contact with the negative pin, and an on-off component for controlling connection and disconnection of the conductive shift block and the conductive mounting base is arranged between the conductive shift block and the conductive mounting base.

In this way, by inserting one end of the conductive mounting base in the arrow shaft, stable installation is achieved, and the battery is located in the arrow shaft, so that a good protection effect is realized. At the beginning, the positive pin of the LED is connected with the positive end of the battery; in use, the nock body is clamped on a bowstring, fingers are wrapped around the two sides of the nock body and act on the conductive shift block when the arrow is shot to urge the conductive shift block to slide on the nock body, meanwhile, by means of the on-off component, the negative pin of the LED is communicated with the negative end of the battery through the conductive mounting base. That is, the positive pin and the negative pin of the LED are made to be in contact with the positive end and the negative end of the battery respectively to form an electric circuit, and the LED is lit up. That is, when the bowstring is pulled, the on-off component controls the LED to be lit up automatically, so that quick starting is realized. When the arrow is drawn back, by shifting the conductive shift block, the on-off component controls the LED and the battery to be disconnected, and the LED is turned off automatically. Connection and disconnection of the battery and the LED can be achieved quickly by controlling the on-off component, so that the LED can be turned on or off quickly, with convenient operation and recycling use.

Further, a receiving groove is formed in one end of the conductive mounting base, the battery is arranged in the receiving groove, one end of the nock body is inserted into the receiving groove, the on-off component includes a check ring and a spring which are sleeved on the nock body; in a natural state, the two ends of the spring abut against the check ring and a port of the receiving groove respectively, and the conductive shift block abuts against the check ring when the LED emits light.

In this way, by arranging the battery in the receiving groove of the mounting base, a good protection effect is realized. By inserting the nock body in the receiving groove, fixed connection of the conductive mounting base and the nock body is realized. When the bowstring is pulled, the bowstring reacts on the conductive shift block under stress to urge the conductive shift block to slide on the nock body and then abut against the check ring, and the spring is pressed on the nock body. At the moment, the negative pin of the LED is communicated with the negative end of the battery through the conductive shift block, the spring and the conductive mounting base in sequence. The positive pin and the negative pin of the LED are made to be in contact with the positive end and the negative end of the battery respectively to form an electric circuit, and the LED is lit up.

Further, a limiting ring is perpendicularly connected to the check ring, a motion cavity is defined by the limiting ring, the check ring and the nock body, the spring is arranged in the motion cavity, a limiting lug is arranged on the outer circumferential wall of the nock body; in a natural state, the check ring abuts against the limiting lug, and the conductive shift block is slidably sleeved on the limiting lug.

In this way, when the arrow is shot, the conductive shift block is urged to slide on the limiting lug and then abut against the limiting ring on the check ring, the spring is pressed in the motion cavity, and the stability of the spring in a pressed state is improved. At the moment, the negative pin of the LED is communicated with the negative end of the battery through the conductive shift block, the spring and the conductive mounting base in sequence, the positive pin and the negative pin of the LED are made to be in contact with the positive end and the negative end of the battery respectively to form an electric circuit, the stability of contact between the conductive shift block and the conductive mounting base is improved through the spring, and the LED is lit up. When the arrow is drawn back, by shifting the conductive shift block, the spring restores, the limiting ring continues to restore, so that the limiting ring and the conductive shift block are disconnected, and the LED is turned off for quick and stable outage.

Further, a bowstring clamping groove is formed in the nock body, the bowstring clamping groove divides the tail end of the nock body into a first bowstring piece and a second bowstring piece, and reinforcing ribs are integrated on the outer wall of the first bowstring piece and on the outer wall of the second bowstring piece respectively.

In this way, in use, the bowstring clamping groove in the nock body is clamped onto the bowstring, and the first bowstring piece and the second bowstring piece have a bowstring stabilizing and limiting effect; meanwhile, fingers are wrapped around the reinforcing ribs on the two sides of the nock body, so that the stability of contact between fingers and the nock body and the structural strength of the nock body are improved.

Further, the conductive shift block includes a hollow contact piece slidably sleeved on the nock body, a boss wrapped around the contact piece, and connecting pieces symmetrically arranged at one port of the boss and integrally connected with the boss, the contact piece is in contact with the negative pin, the connecting pieces protrude out of a groove opening of the bowstring clamping groove, another port of the boss abuts against the spring, and skidproof stripes are arranged on the outer wall of each connecting piece.

In this way, the bowstring clamping groove in the nock body is clamped onto the bowstring when in use. When the arrow is shot, the bowstring acts on the connecting pieces to urge the conductive shift block to slide on the nock body, the contact piece is in contact with the negative pin all the time, then the boss abuts against the check ring, and the spring is pressed between the boss and the conductive mounting base. By arranging the skidproof stripes on the connecting pieces, mutual friction force is improved between fingers and the conductive mounting base, and the operating performance is improved on the conductive mounting base.

Further, a clamping groove used for installing the LED is formed in the side wall of the nock body, an insertion groove communicated with the clamping groove is formed in one end of the nock body, the negative pin is arranged on the outer side of the nock body, the positive pin is arranged in the insertion groove, a positive rod is connected to the positive end of the battery, and the positive rod is inserted into the insertion groove and connected with the positive pin.

In this way, the LED is stably and fixedly arranged on the nock body through the clamping groove, the negative pin is connected with the negative rod of the battery by being arranged in the insertion groove, and the negative pin is arranged outside and connected with and disconnected from the negative end of the battery through the on-off component.

Further, the conductive mounting base includes an installing body used for installing the battery, a clamping body used for installing the nock body and a limiting body used for limiting the insertion position of the clamping body in an arrow shaft, wherein the installing body, the clamping body and the limiting body are integrally connected, and the diameter of the installing body is larger than the diameter of the clamping body.

In this way, the installing body facilitates battery installation, meanwhile, the clamping body is in contact with the arrow shaft, so that the lighted nock device can be stably installed on the arrow shaft, and the limiting body is adopted to limit the insertion of the conductive mounting base in the arrow shaft, so that the installing stability of the conductive mounting base on the arrow shaft is improved.

Further, multiple circles of clamping stripes used for clamping the inner wall of the arrow shaft are arranged on the outer circumferential wall of the clamping body at intervals, and the diameter of the limiting body is larger than the diameter of the installing body.

In this way, friction force between the clamping body and the arrow shaft can be improved through the clamping stripes, the friction coefficient between the conductive mounting base and the arrow shaft when the conductive mounting base is installed in the arrow shaft is increased, and the stability between the conductive mounting base and the arrow shaft after installation is improved.

Further, an annular groove is formed in the outer circumferential wall, facing the port of the receiving groove, of the battery, the annular groove is sleeved with a sealing ring, and the sealing ring is in interference fit with the receiving groove.

In this way, by arranging the sealing ring on the battery, the sealing ring is clamped in the annular groove, and stable installation of the battery pack and the nock body is realized through interference fit.

Further, the nock body is an optically transparent or a semi-transparent plastic part.

In this way, the light transmittance of the lit LED in the nock body is high, facilitating observation and searching.

By adopting the above technical solutions, compared with the prior art, the lighted nock device has the advantages that:

1. connection and disconnection of the battery and the LED can be achieved quickly by controlling the on-off component, so that the LED can be turned on or off quickly, with convenient operation and recycling use;

2. by arranging the check ring, the limiting ring and the spring, stable contact between the conductive shift block and the conductive mounting base is guaranteed by means of the elastic property of the spring when the LED and the battery are energized, so as to improve stable connection between the LED and the battery by the conductive shift block and the conductive mounting base when the LED; and 3. the check ring and the limiting ring are limited by the limiting lug to slide on the nock body, complete separation is realized after the conductive shift block and the conductive mounting base are disconnected, and usability is improved.

DETAILED DESCRIPTION OF THE INVENTION

A lighted nock device is further illustrated with reference to FIG. 1 to FIG. 8.

Figure 1:
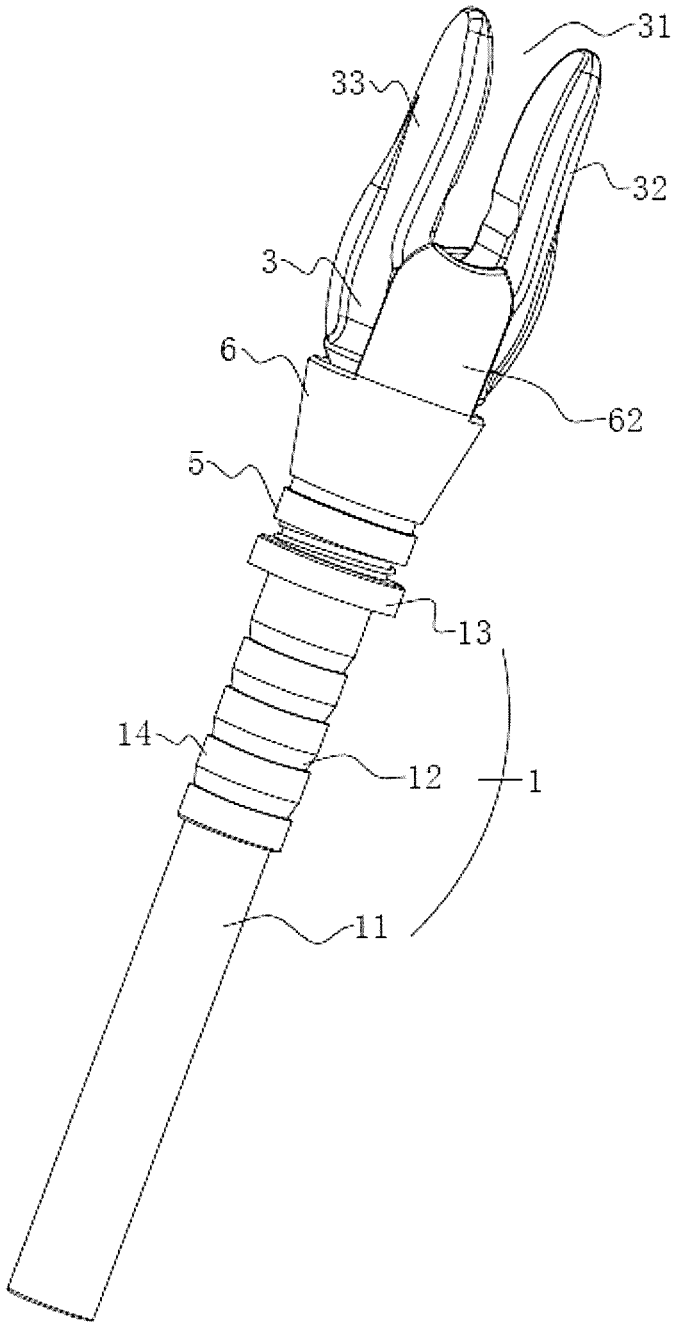
FIG. 1 is a structural schematic illustration of a lighted nock device.
Figure 2:
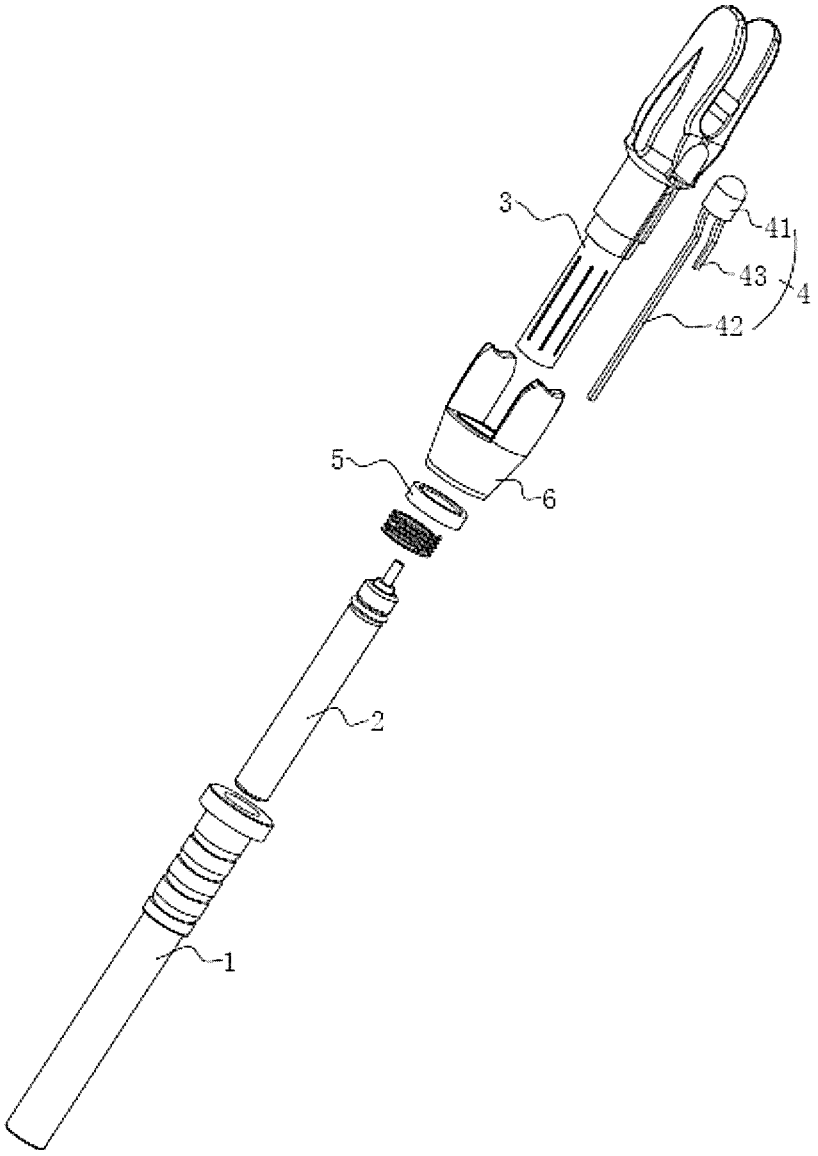
FIG. 2 is an exploded view of the lighted nock device.

A lighted nock device, as shown in FIG. 1 and FIG. 2, includes a conductive mounting base 1 with one end being connected with an arrow shaft, a battery 2 fixedly installed in the conductive mounting base 1, a nock body 3 fixedly inserted in the conductive mounting base 1, an LED 4 fixedly arranged on the nock body 3, and an on-off component 5 controlling the LED 4 to be turned on/off. The conductive mounting base 1 is made of metallic aluminum and is in contact with the negative electrode of the battery 2, and the nock body 3 is an optically transparent or a semi-transparent plastic part.

Figure 3:
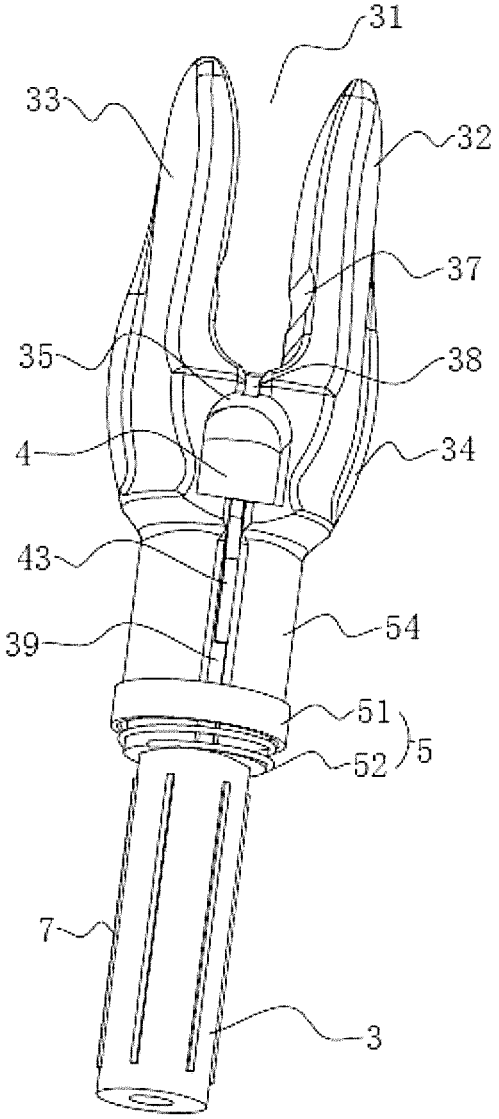
FIG. 3 is a structural schematic illustration of a nock body in the lighted nock device.

As shown in FIG. 2, the LED 4 includes a lamp body 41 and a positive pin 42 and a negative pin 43 which are connected with the lamp body 41. Referring to FIG. 3, a bowstring clamping groove 31 used for clamping a bowstring is formed in the nock body 3, and the groove width of the middle of the bowstring clamping groove 31 is smaller than that of the bottom of the groove and that of a groove opening. Meanwhile, the bowstring clamping groove 31 divides one tail end of the nock body 3 into a first bowstring piece 32 and a second bowstring piece 33, and reinforcing ribs 34 are integrated on the outer wall of the first bowstring piece 32 and on the outer wall of the second bowstring piece 33 respectively. Limiting grooves 37 used for clamping the bowstring are formed in the middle of the inner wall of the first bowstring piece 32 and in the middle of the inner wall of the second bowstring piece 33 respectively.

Figure 7:
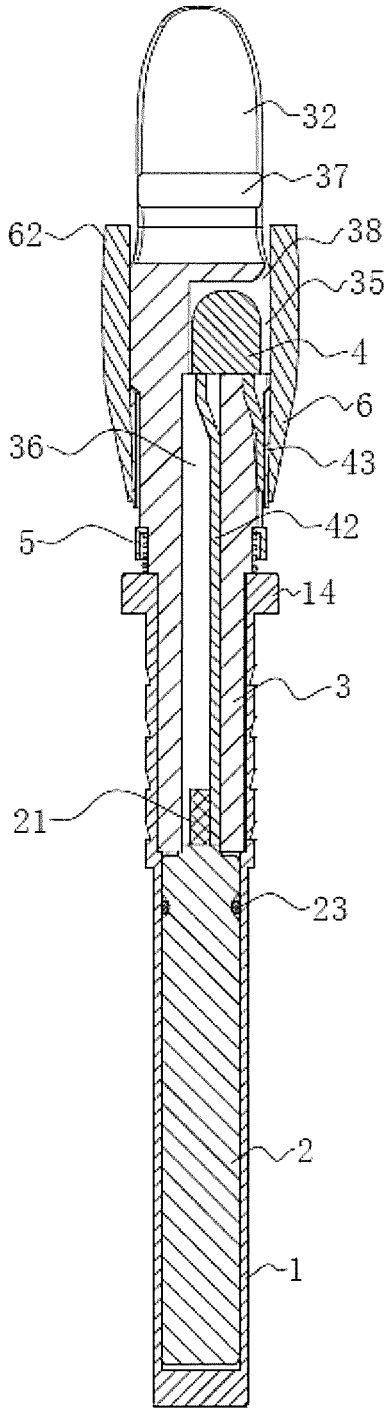
FIG. 7 is a sectional view of a bowstring clamping groove in the lighted nock device.

As shown in FIG. 3, a clamping groove 35 used for installing the LED 4 is formed in the side wall of the nock body 3, and the lamp body 41 of the LED 4 is fixed in the clamping groove 35. Meanwhile, a guide-in groove 38 allowing the LED 4 to be guided in the clamping groove 35 conveniently is formed in the side, facing the bowstring clamping groove 21, of the clamping groove 35. Referring to FIG. 7, an insertion groove 36 communicated with the clamping groove 35 is formed in the other end of the nock body 3, the negative pin 43 is arranged on the outer side of the nock body 3, the positive pin 42 is arranged in the insertion groove 36, an accommodating groove 39 allowing the negative pin 43 to be placed therein conveniently is formed in the outer wall of the nock body 3, and the groove depth of the end, inserted into the conductive mounting base 1, of the accommodating groove 39 is larger than the groove depth of the end facing the first bowstring piece.

Figure 4:
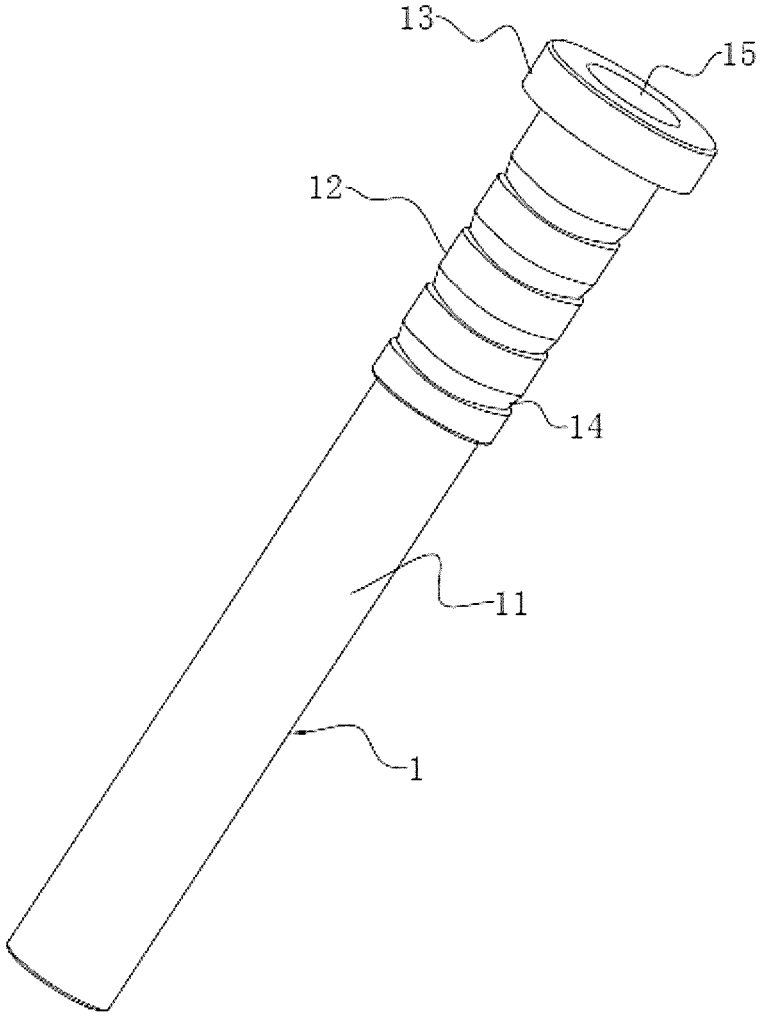
FIG. 4 is a structural schematic illustration of a conductive mounting base in the lighted nock device.

Referring to FIG. 2 and FIG. 4, the conductive mounting base 1 includes an installing body 11 provided with an installing bin used for installing the battery 2, a clamping body 12 used for installing the nock body 3 onto an arrow shaft, and a limiting body 13 used for limiting the insertion position of the clamping body 12 in the arrow shaft, and the installing body 11, the clamping body 12 and the limiting body 13 are integrally and sequentially connected. The installing body 11, the clamping body 12 and the limiting body 13 are all made of metallic aluminum, the diameter of the installing body 11 is larger than the diameter of the clamping body 12, and the diameter of the limiting body 13 is larger than the diameter of the installing body 11.

As shown in FIG. 4, to install the conductive mounting base 1 in the arrow shaft conveniently, multiple circles of clamping stripes 14 used for clamping the inner wall of the arrow shaft are arranged on the outer circumferential wall of the clamping body 12 at intervals.

Referring to FIG. 3 and FIG. 4, a receiving groove 15 is formed in one end of the conductive mounting base 1, the battery 2 is arranged in the receiving groove 15, and one end of the nock body 3 is inserted in the receiving groove 15 so as to seal the receiving groove 15 and effectively protect the battery 2. Meanwhile, anti-slip strips 7 are arranged on the outer circumferential wall of the end, inserted in the receiving groove 15, of the nock body 3, and the multiple anti-slip strips 7 are evenly arranged on the nock body 3.

Figure 5:
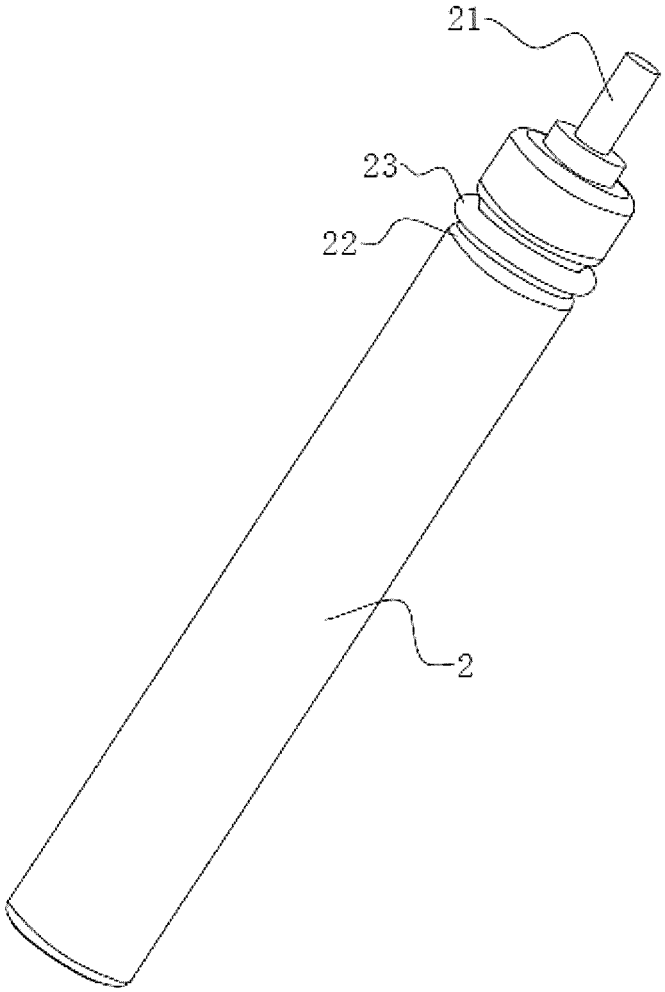
FIG. 5 is a structural schematic illustration of a battery and a sealing ring in the lighted nock device.
Figure 6:
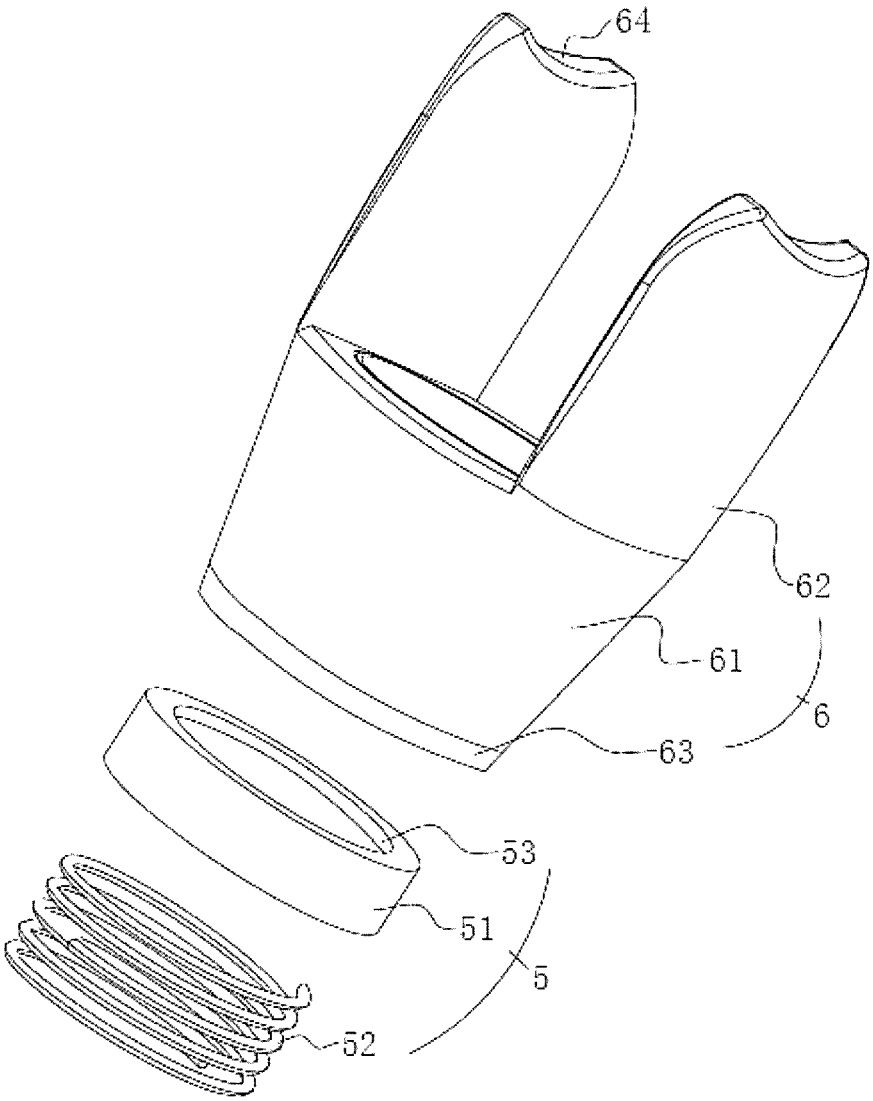
FIG. 6 is a structural schematic illustration of a conductive shift block and an on-off component in the lighted nock device.

As shown in FIG. 5, an annular groove 22 is formed in the outer circumferential wall, facing a port of the receiving groove 15, of the battery 2, the annular groove 22 is sleeved with a sealing ring 23, and referring to FIG. 4, the sealing ring 23 is in interference fit with the receiving groove 15.

Referring to FIG. 7, a positive rod 21 is connected to the positive end of the battery 2, and the positive rod 21 is inserted in the insertion groove 36 and connected with the positive pin 42. A conductive shift block 6 is slidably arranged on the nock body 3, referring to FIG. 6, the conductive shift block 6 includes a hollow contact piece 63 slidably sleeved on the nock body 3, a boss 61 wrapped around the contact piece 63, and connecting pieces 62 symmetrically arranged at one port of the boss 61 and integrally connected with the boss 61, and the end, facing the check ring 51, of the contact piece 63 protrudes out of the boss 61.

As shown in FIG. 1, the connecting pieces 62 protrude out of the groove opening of the bowstring clamping groove 31, that is, a cross shape is formed by the first bowstring piece 32, the second bowstring piece 33 and the two connecting pieces 62. Referring to FIG. 3, an arc-shaped notch 64 is formed in the end, facing the first bowstring piece 32, of each connecting piece 62, meanwhile, the face, in contact with the connecting pieces 62, of the nock body 3 is set to be a plane. To facilitate sliding of the conductive shift block 6, skidproof stripes (not shown in the drawings) are arranged on the outer wall of each connecting piece 62.

Figure 8:
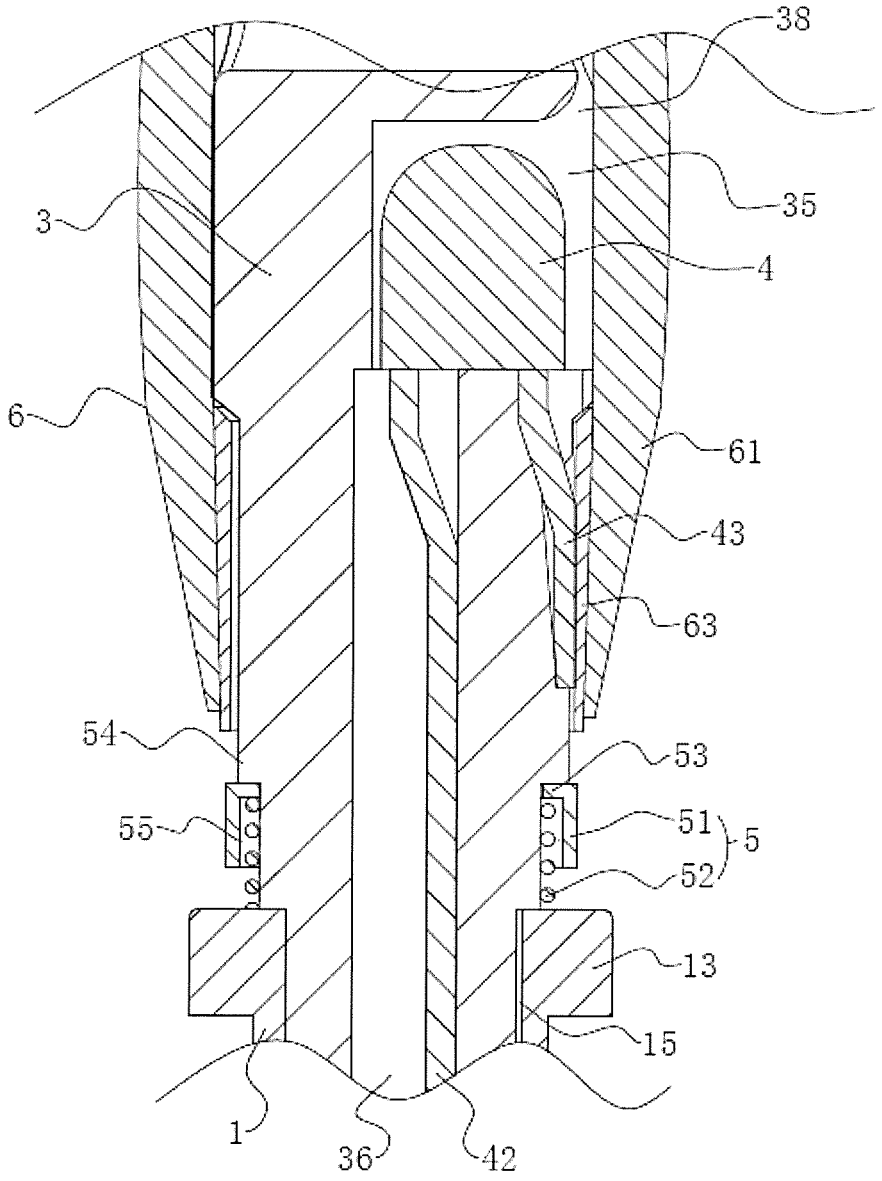
FIG. 8 is partial sectional view of the on-off component in the lighted nock device.

Referring to FIG. 7 and FIG. 8, the contact piece 63 is in contact with the negative pin 43 all the time, and the on-off component 5 is arranged between the conductive shift block 6 and the conductive mounting base 1 and acts on the connecting pieces 62 through the bowstring, so as to control connection and disconnection of the conductive shift block 6 and the conductive mounting base 1.

Referring to FIG. 7 and FIG. 8, the on-off component 5 includes a check ring 51 sleeved on the nock body 3 and a spring 52, and the initial state of the spring 52 is a pressed state. A limiting ring 53 is perpendicularly connected to the check ring 51, a limiting lug 54 is arranged on the outer circumferential wall of the nock body 3, a motion cavity 55 is defined by the limiting ring 53, the check ring 51 and the limiting lug 54. In a natural state, the two ends of the spring 52 abut against the check ring 51 and a port of the receiving groove 15 in the limiting body 13, and the spring 52 is located in the motion cavity 55 for deformation.

As shown in FIG. 8, the conductive shift block 6 is slidably sleeved on the limiting lug 54. In a natural state, the limiting ring 53 on the check ring 51 abuts against the limiting lug 54 through the return force of the spring 52. When the LED 4 emits light, the spring 52 is pressed again, the conductive shift block 6 abuts against the check ring 51, and the friction force between the conductive shift block 6 and the limiting lug 54 is larger than the return force of the spring 52.

Operating principle: the clamping body 12 of the conductive mounting base 1 is inserted in the arrow shaft, stable installation is achieved by means of the clamping stripes 14, meanwhile, the installing body 11 and the battery 2 in the receiving groove 15 are located in the arrow shaft, and a good protection effect is realized. At the beginning, the positive pin 42 of the LED 4 is connected with the positive rod 21 of the battery 2. In use, fingers are wrapped around the reinforcing ribs 34 on the two sides of the nock body 3, the bowstring clamping groove 31 in the nock body 3 is clamped to the bowstring, meanwhile, the lighted nock device is tightly clamped to the bowstring through the limiting grooves 37; when the arrow is shot, due to the fact that the connecting pieces 62 on the conductive shift block 6 protrude out of the bowstring clamping groove 31, the bowstring acts on the connecting pieces 62 under inertia force when the arrow is shot, so as to urge the conductive shift block 6 to slide on the limiting lug 54 and then abut against the limiting ring 53 on the check ring 51, and the spring 52 is pressed on the nock body 3. At the moment, the negative pin 43 of the LED 4 is communicated with the negative end of the battery 2 through the contact piece 63, the spring 52 and the conductive mounting base 1 in sequence, the positive pin 42 and the negative pin 43 of the LED 4 are made to be in contact with the positive end and the negative end of the battery 2 respectively to form an electric circuit, and the LED 4 is lit up. That is, when the arrow is shot, the LED 4 is lit up automatically, so that quick starting is realized. When the arrow is drawn back, the spring 52 restores by shifting the conductive shift block 6, the limiting ring 53 continues to restore and finally abuts against the limiting lug 54, so that the limiting ring 53 and the contact piece 63 are disconnected, the LED is turned off, and quick outage is realized. Connection and disconnection of the battery 2 and the LED 4 can be achieved quickly by controlling the on-off component 5, so that the LED 4 can be turned on or off quickly, with convenient operation and recycling use.

Figure 9:
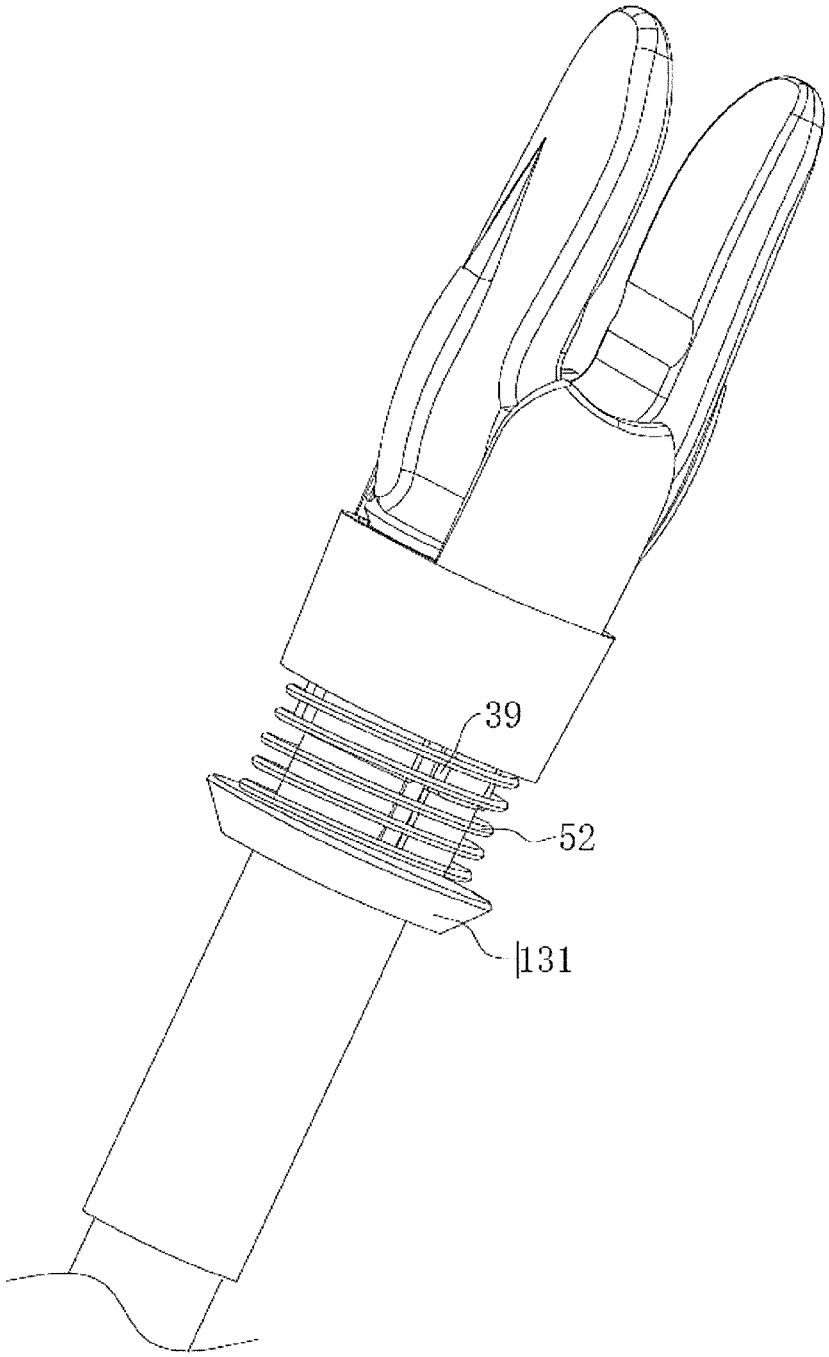
FIG. 9 shows another embodiment of the invention.

FIG. 9 shows another embodiment of the invention, which comprises: a pair of diametrically opposite keys 39 formed with the nock body 3 and axially extended so as to abut with the spring 52 and to match and guide the conductive shift block 6; and a cone 131 formed with the limiting body 13 and having a leading tapered end.

The foregoing descriptions are merely preferred embodiments of the invention, and the protection scope of the invention is not limited to the above embodiments. All the technical solutions belonging to the idea of the invention belong to the protection scope of the invention. It should be noted that those skilled in the art may make improvements and modifications without departing from the principle of the invention, and these improvements and modifications shall also fall within the protection scope of the invention.

The invention claimed is:

1. A lighted nock device, comprising:

a nock body, an LED, a conductive mounting base and a battery, wherein the LED comprises a lamp body and a positive pin and a negative pin which are connected with the lamp body, and wherein the LED is arranged in the nock body, the battery is arranged in the conductive mounting base, a negative electrode of the battery is in contact with the conductive mounting base, one end of the nock body is inserted into the conductive mounting base, the positive pin is connected with a positive electrode of the battery, a conductive shift block is slidably arranged around the nock body, the conductive shift block is slidably in contact with the negative pin, and an on-off component for controlling connection and disconnection of the conductive shift block and the conductive mounting base is arranged between the conductive shift block and the conductive mounting base;

wherein a receiving groove is formed in one end of the conductive mounting base, the battery is arranged in the receiving groove, and the one end of the nock body is inserted into the receiving groove, the on-off component comprises a check ring and a spring which are sleeved on the nock body, in a natural state, two opposite ends of the spring abut against the check ring and a port of the receiving groove respectively, and the conductive shift block abuts against the check ring when the LED emits light;

wherein a bowstring clamping groove is formed in the nock body, the bowstring clamping groove divides a tail end of the nock body into a first bowstring piece and a second bowstring piece;

wherein the conductive shift block comprises a hollow contact piece slidably sleeved on the nock body, a boss wrapped around the contact piece, and a pair of connecting pieces symmetrically arranged at one port of the boss and integrally connected with the boss, the contact piece is in contact with the negative pin, the connecting pieces extend axially clear off a groove opening of the bowstring clamping groove, another port of the boss abuts against the spring.

2. The lighted nock device according to claim 1, wherein a limiting ring is perpendicularly connected to the check ring, a motion cavity is defined by the limiting ring, the check ring and the nock body, the spring is arranged in the motion cavity, and a limiting lug is arranged on an outer circumferential wall of the nock body, in a natural state, the check ring abuts against the limiting lug, and the conductive shift block is slidably sleeved on the limiting lug.

3. The lighted nock device according to claim 1, wherein a clamping groove used for installing the LED is formed in a side wall of the nock body, an insertion groove communicated with the clamping groove is formed in one end of the nock body, the negative pin is arranged on an outer side of the nock body, the positive pin is arranged in the insertion groove, a positive rod is connected to a positive end of the battery, and the positive rod is inserted into the insertion groove and connected with the positive pin.

4. The lighted nock device according to claim 1, wherein the conductive mounting base comprises an installing body used for installing the battery, a clamping body used for installing the nock body, and a limiting body used for limiting the insertion position of the clamping body in an arrow shaft, wherein the installing body, the clamping body and the limiting body are integrally connected, and a diameter of the installing body is smaller than a diameter of the clamping body.

5. The lighted nock device according to claim 4, wherein multiple circles of clamping stripes used for clamping an inner wall of the arrow shaft are arranged on an outer circumferential wall of the clamping body at intervals, and a diameter of the limiting body is larger than the diameter of the installing body.

6. The lighted nock device according to claim 1, wherein an annular groove is formed in an outer circumferential wall, facing the port of the receiving groove, of the battery, the annular groove is sleeved with a sealing ring, and the sealing ring is in interference fit with the receiving groove.

7. The lighted nock device according to claim 1, wherein the nock body is an optically transparent or a semi-transparent plastic part.

* * * * *